US011466471B2

(12) United States Patent
Yanda et al.

(10) Patent No.: US 11,466,471 B2
(45) Date of Patent: Oct. 11, 2022

(54) SMART CITY MODULES AND SYSTEM

(71) Applicant: Champion Optical Network Engineering, LLC, Independence, OH (US)

(72) Inventors: Timothy G. Yanda, Independence, OH (US); John M. Jutila, Independence, OH (US)

(73) Assignee: Champion Optical Network Engineering, LLC, Independence, OH (US)

( * ) Notice: Subject to any disclaimer, the term of this patent is extended or adjusted under 35 U.S.C. 154(b) by 67 days.

(21) Appl. No.: 17/167,650

(22) Filed: Feb. 4, 2021

(65) Prior Publication Data

US 2021/0246681 A1 Aug. 12, 2021

Related U.S. Application Data

(60) Provisional application No. 62/972,482, filed on Feb. 10, 2020.

(51) Int. Cl.
*E04H 12/00* (2006.01)
*E04H 12/22* (2006.01)

(52) U.S. Cl.
CPC ..... *E04H 12/003* (2013.01); *E04H 12/2261* (2013.01)

(58) Field of Classification Search
CPC . E04H 1/1205; E04H 12/003; E04H 12/2261; G09F 13/04; G09F 9/3026; G09F 13/0431
See application file for complete search history.

(56) References Cited

U.S. PATENT DOCUMENTS

| | | | | |
|---|---|---|---|---|
| 5,542,203 | A * | 8/1996 | Luoma | G09F 9/3026 340/908 |
| 10,650,711 | B2 * | 5/2020 | Vugts | G09F 23/0082 |
| 2006/0260161 | A1 * | 11/2006 | Hamilton | G09F 13/04 40/541 |
| 2007/0253208 | A1 * | 11/2007 | Howard | F21V 21/116 362/373 |
| 2009/0178316 | A1 * | 7/2009 | Parenti | G09F 23/04 40/606.12 |
| 2009/0183405 | A1 * | 7/2009 | Wilkes | G09F 27/007 40/543 |
| 2013/0141902 | A1 * | 6/2013 | Akdag | F24S 25/10 248/530 |
| 2018/0049350 | A1 * | 2/2018 | Lee | G09F 27/005 |
| 2018/0175661 | A1 * | 6/2018 | Tuerk | H02S 10/20 |
| 2019/0289756 | A1 * | 9/2019 | Lee | G09F 27/005 |
| 2020/0116318 | A1 * | 4/2020 | Bembridge | F21V 21/10 |
| 2020/0221586 | A1 * | 7/2020 | Gao | G09G 5/373 |
| 2021/0232820 | A1 * | 7/2021 | Hill | G06V 20/52 |
| 2022/0125170 | A1 * | 4/2022 | Nion | A45B 23/00 |

* cited by examiner

*Primary Examiner* — Gisele D Ford
(74) *Attorney, Agent, or Firm* — McCarthy, Lebit, Crystal & Liffman, Co., L.P.A

(57) ABSTRACT

The present invention relates to a system to provide a smart city platform for urban areas by utilizing module units that contain multiple types of technology and equipment. A smart city platform is created with a multiplicity of module units installed throughout a cityscape. The module units house various equipment, such as various antennas, cables, brackets and other equipment, to enable smart city connectivity and services and may be additionally fitted with service station units to provide extra capabilities and services to communities.

14 Claims, 26 Drawing Sheets

SMART CITY MODULES AND SYSTEM

RELATED APPLICATIONS

This application claims the benefit of previously filed U.S. provisional application 62/972,482.

BACKGROUND OF THE INVENTION

Field of the Invention

The present invention relates to the technology of the Internet of Things (IoT), specifically modules and a system for designing, installing and providing a smart city in urban environments through the use of uniform, small-footprint pods.

Background

Improved and increased connectivity is in high demand as communities and cities push to streamline electronic and digital technologies employed by those who live and work in them. Communities that are able to implement smart city infrastructure are able to provide benefits to their citizens, increase efficiencies in physical infrastructure, create real economic opportunities, increase safety and security, and ultimately learn, adapt and innovate to improve the quality of life. Smart cities use an integration of digital telecommunication networks and technological infrastructure to create the desired framework for the smart city. This requires a holistic, customized approach that accounts for city cultures, long-term city planning, and local regulations.

As communities desire to transition into smart cities, it is increasingly important to facilitate this transition and to create a uniform platform. This will ensure capability throughout the platform and ease of expanding or changing as the needs of the community develop and grow. Therefore, there is a need to create a system that allows for a streamlined implementation of smart city platforms.

SUMMARY OF THE INVENTION

These and other objects are achieved by the instant invention. The present invention is a module and system that by containing multiple types of equipment can provide a smart city platform for urban areas.

It is an object and advantage of the present invention to create a smart city platform enabling a wide variety of public services requiring power and communications interconnection that can evolve over time through module units.

It is a feature of the present invention to utilize open architecture to facilitate many vendors desiring to offer products or services that can be incorporated and integrated into the smart city platform.

It is a feature of the present invention for the module units to be sized and designed to accommodate current and future services enabling new technology adoption into strategically placed module units throughout a cityscape.

It is a feature of the present invention for the module units to have an aesthetic look which hides cables, brackets, antennas and other equipment.

It is a feature of the present invention for the module units to have a simple design with a highly functional 'skeleton structure' that can evolve and adapt with changeable 'skins' using a variety of materials, including structural plastics, that can be aesthetically designed.

It is a feature of the present invention to accommodate prefabricated modules for easy field installation.

Briefly described according to one embodiment of the present invention, a smart city platform created with a multiplicity of module units, capable of housing various equipment, such as various antennas, cables, brackets and other equipment, to enable smart city connectivity and services.

These aspects are indicative, however, of but a few of the various ways in which the principles disclosed herein can be employed and is intended to include all such aspects and their equivalents. A more detailed description of the present invention is set forth in the following description. Other advantages and novel features of the present invention are more apparent in the following detailed description of the invention when considered in conjunction with the accompanying drawings.

DESCRIPTION OF THE PREFERRED EMBODIMENTS

Figure 1:
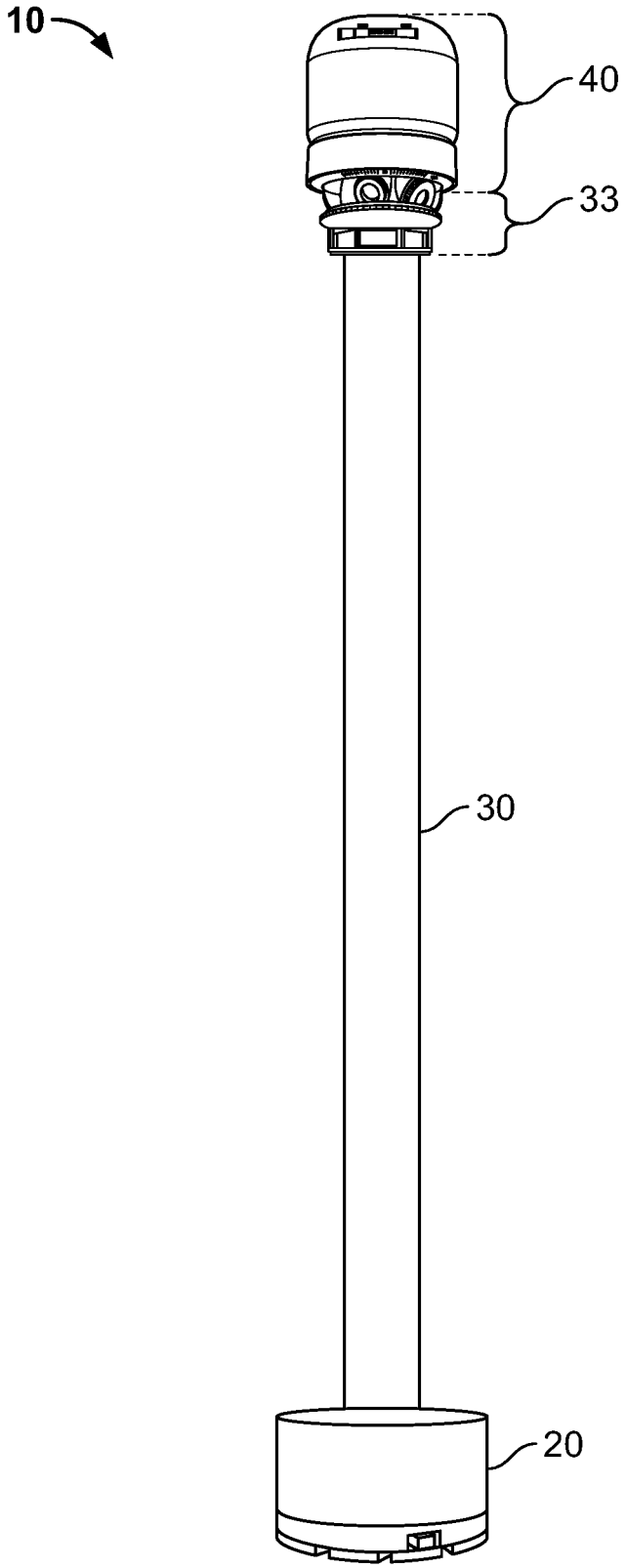
FIG. 1 is a side view of the module unit.

The best mode for carrying out the invention is presented in terms of its preferred embodiment, herein depicted within FIGS. 1 through 27.

DETAILED DESCRIPTION OF THE FIGURES

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

Referring now to the figures, FIG. 1 shows a module unit 10 of the smart city platform. This module unit 10 is comprised of a module base 20 and pod 40 that each contain the majority of the equipment components of the module unit 10. The module base 20 and pod 40 are positioned and affixed at opposite ends of a tower 30 and cables 55 run through the middle of the tower 30 connecting the equipment in the module base 20 and pod 40.

Figure 2:
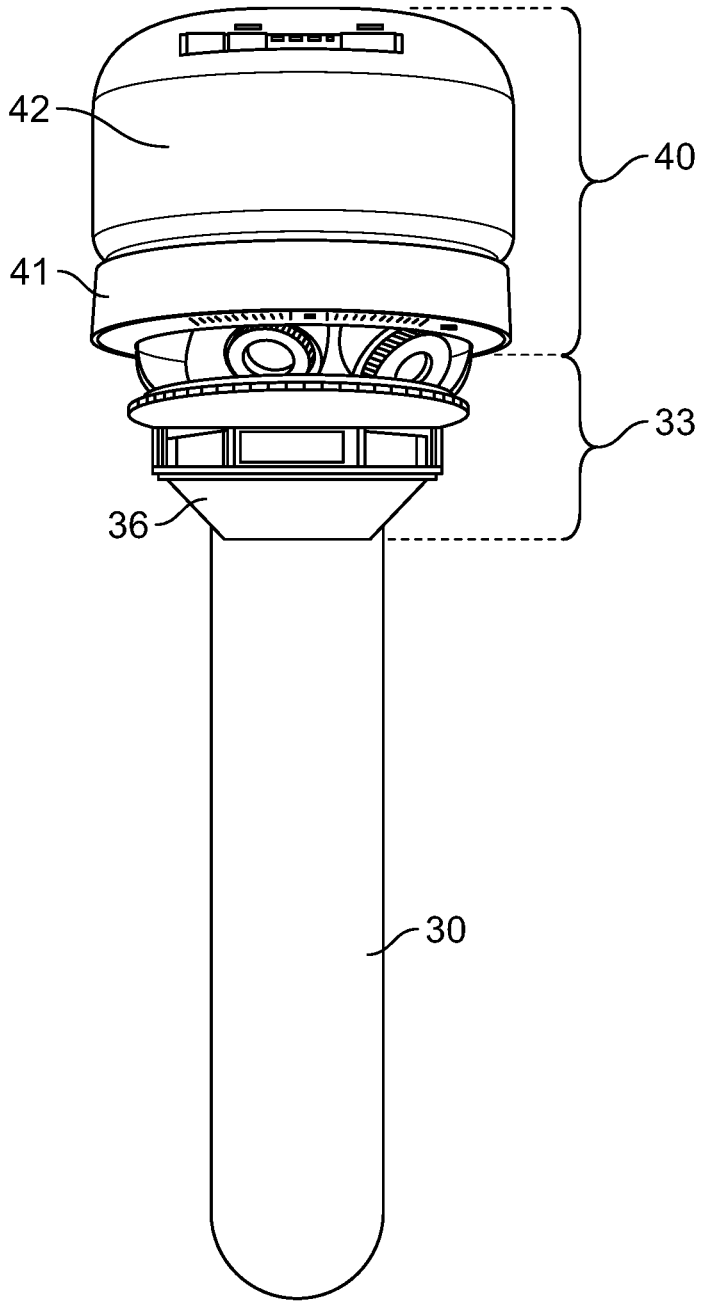
FIG. 2 is a close up of the pod affixed to the top of the pole.
Figure 3:
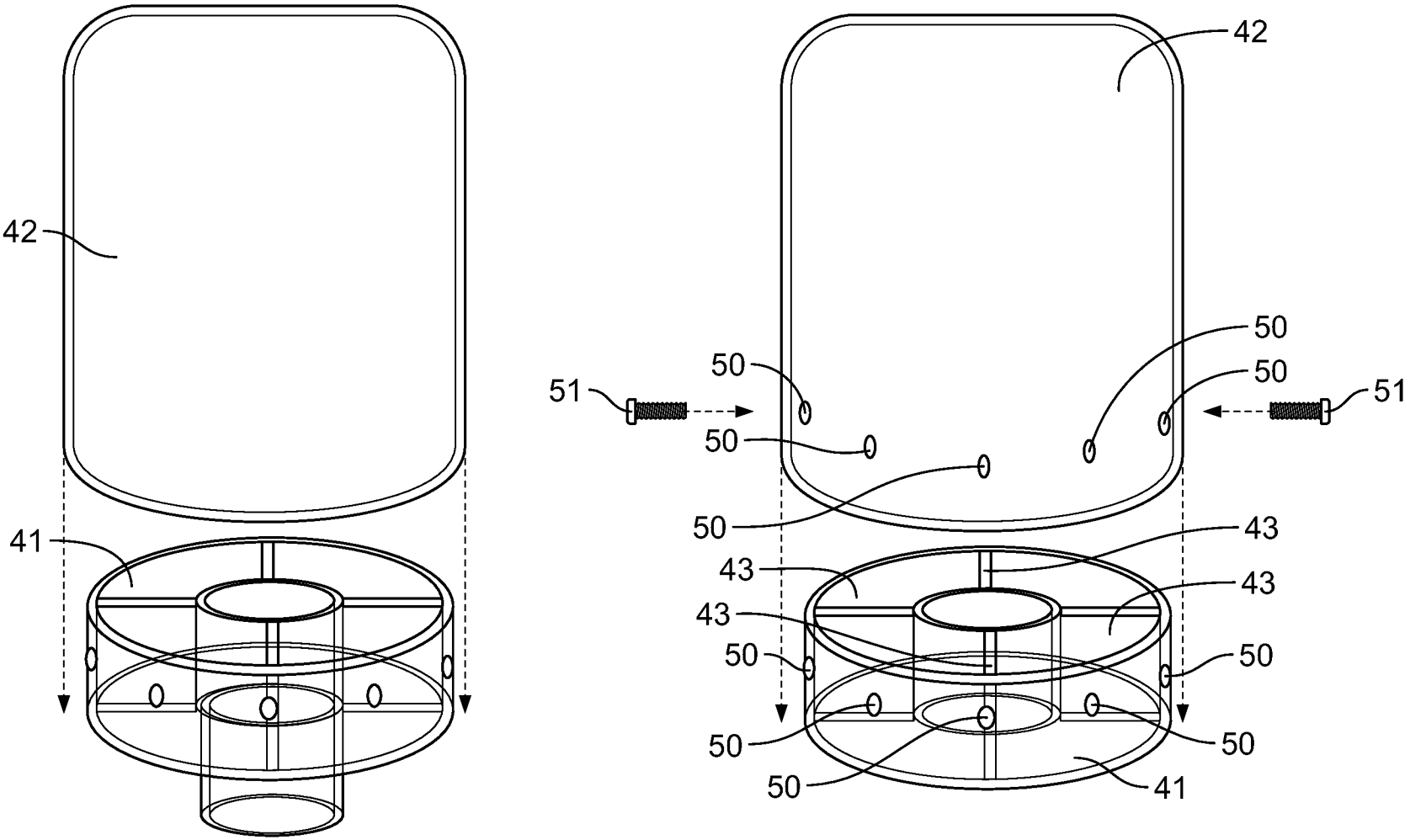
FIG. 3 is an exploded view of the dome and equipment base of the pod unit.

FIG. 2 shows a close up of the pod 40 positioned at the top of the tower 30. The pod 40 comprises an equipment base 41 and dome 42. The dome 42 is fixedly attached to the equipment base 41, as shown in FIG. 3, creating a protective environment for equipment housed 44 inside the pod 40. In this embodiment, the dome 42 is fixedly attached by means of bolting the dome 42 to the equipment base 41; however, it is contemplated that alternate means of fixedly attaching the dome 42 could be used as one skilled in the art would know. It is preferred that the dome 42 be able to be removed and re-seated in order to service, repair or replace the housed equipment 44. Additionally, it is contemplated that void space inside the pod 40 could be filled with foaming agent to further protect the housed equipment 44.

The dome 42 is made of weatherproof material, such as plastic or fiberglass or other lightweight material to minimize weight loading on the tower 30. In one embodiment of the present invention it is contemplated to use MDPE or similar material as one skilled in the art would know. The preferred material is able to withstand sun radiation with minimal oxidation, withstand temperatures from −40° to +85° C. without mechanical stress or fragility. The structural integrity of the dome 42 is able to withstand 200 km/hour wind load without fracture or stress. The best mode for achieving this is believed to be using six radial ⅞ths inch bolts 51 around the base of the dome 42 to anchor it to the equipment base 41. It is recommended to have Material Permittivity Er<3 to minimize radio frequency attenuation or reflections (low conductivity, no carbon additives) from 400 MHz to 71 GHz at 23° C. Further, the dome 42 material should maintain structural integrity to be lowered onto the equipment base 41 for bolt mounting via bolts 51 into pre-drilled and tapped holes 50 and should not warp or deform to enable easy lifting and re-seating.

Figure 4:
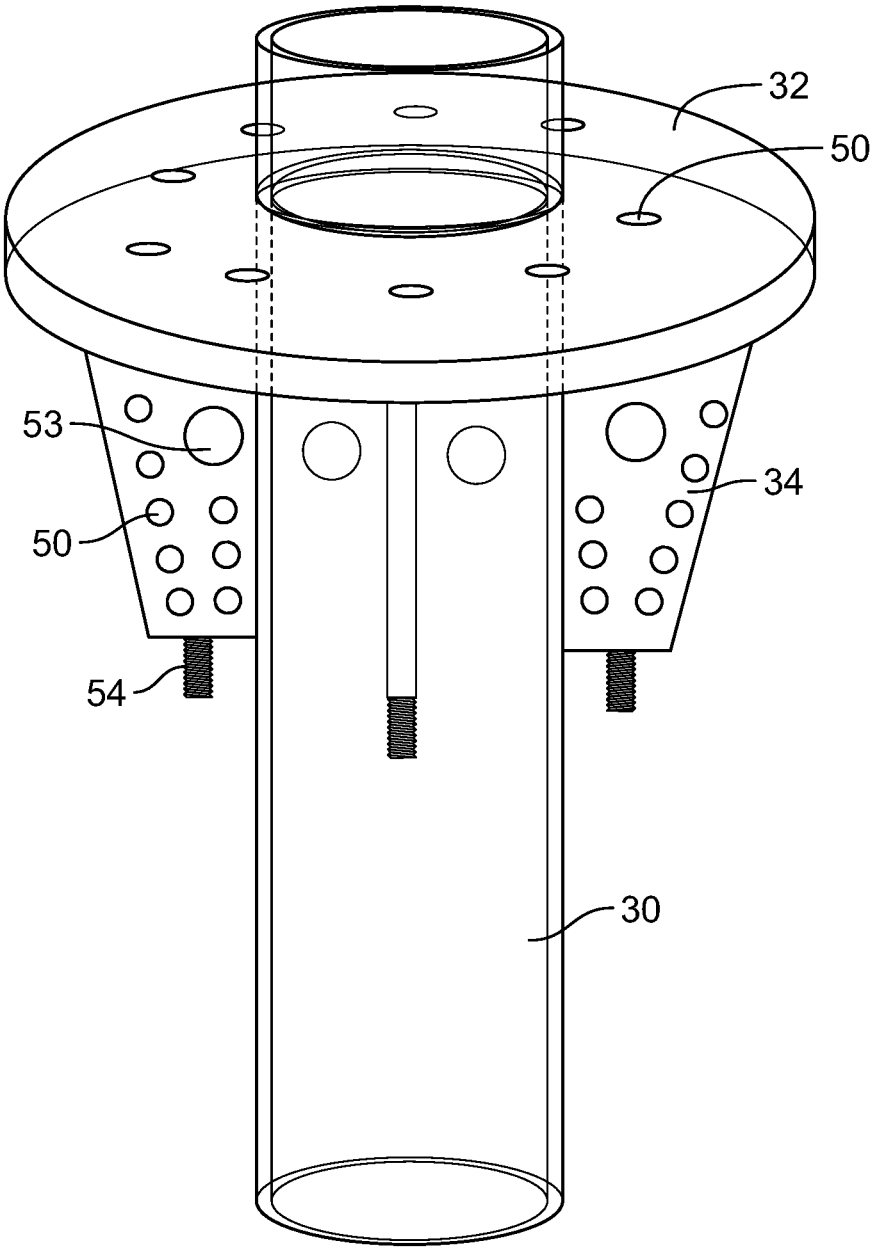
FIG. 4 is a perspective view of the pole shelf overlook area.
Figure 5:
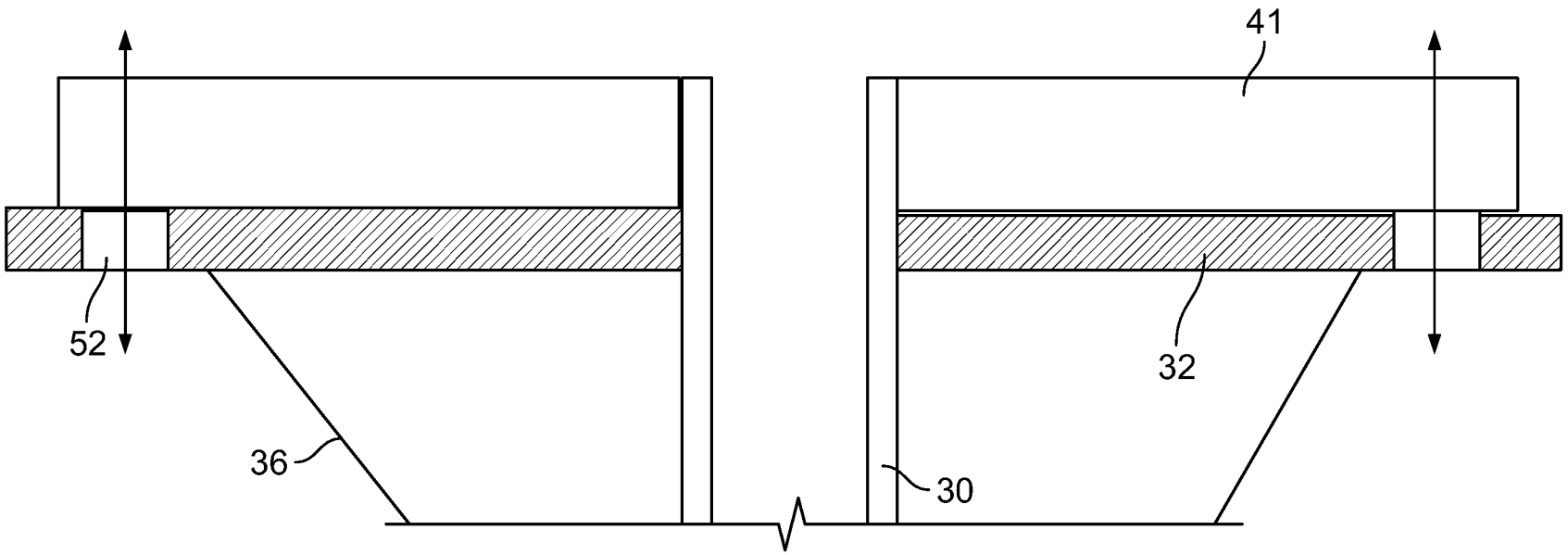
FIG. 5 is a side view of the pole shelf.
Figure 6:
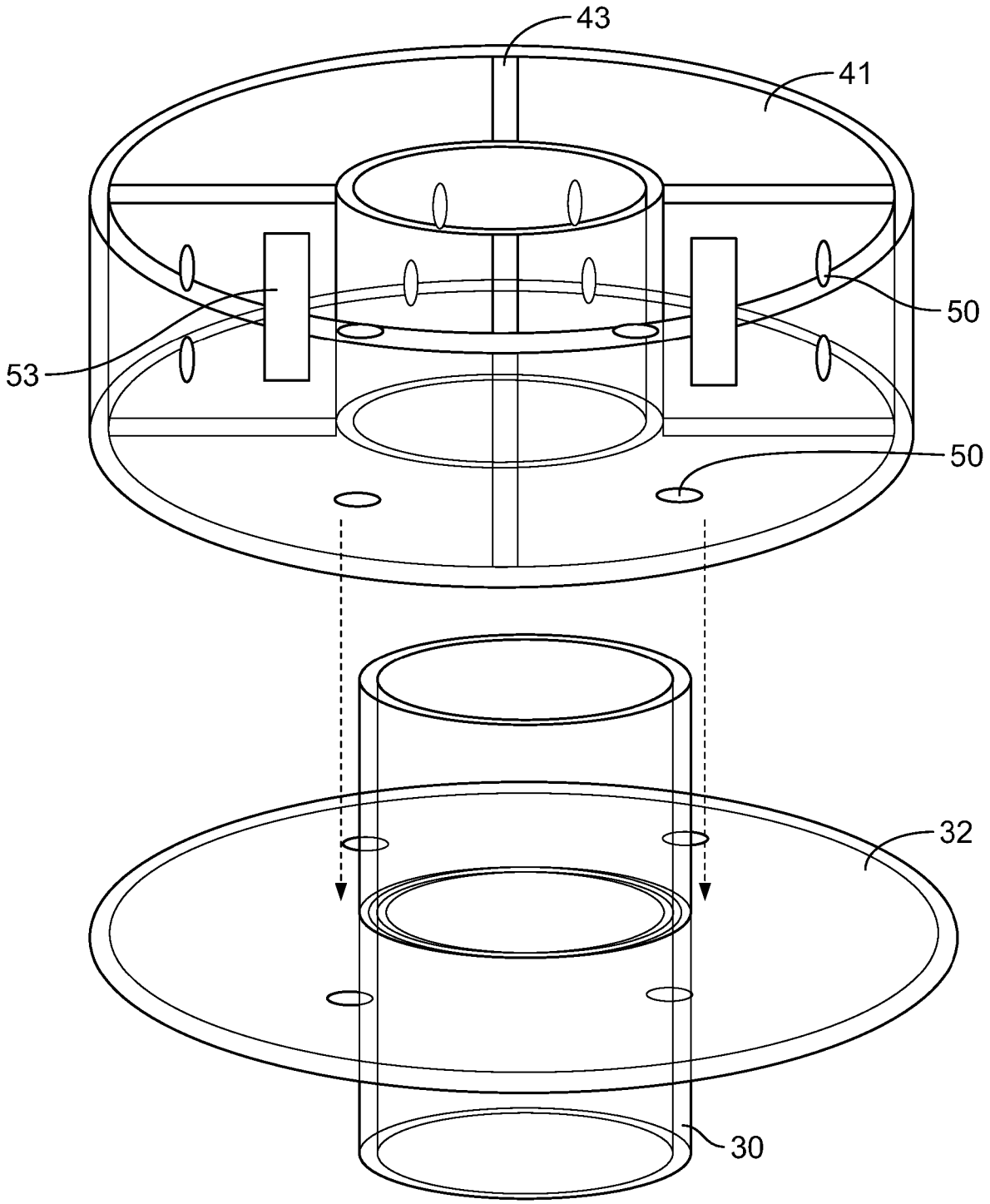
FIG. 6 is an exploded view of the pole shelf and equipment base.
Figure 7:
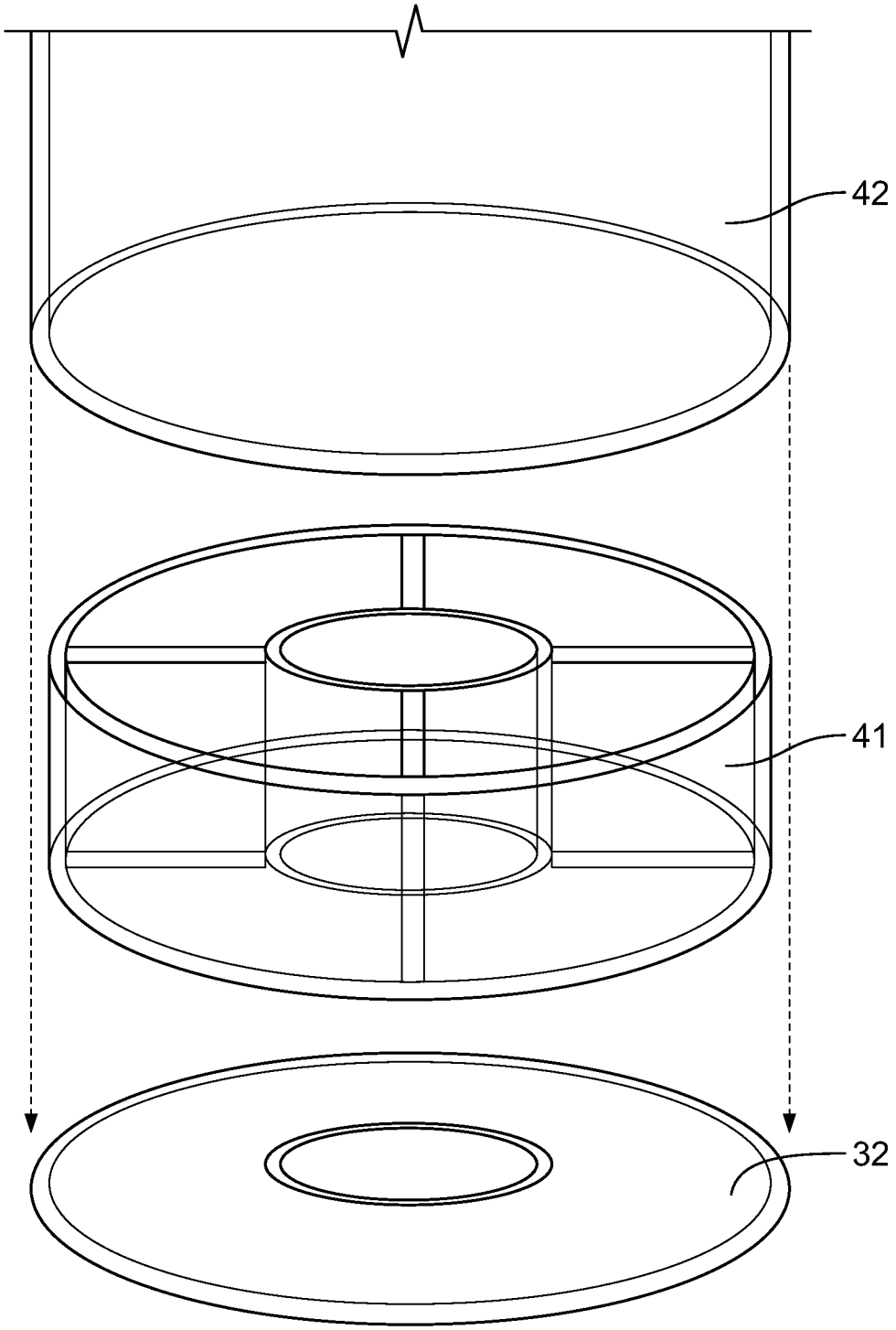
FIG. 7 is an exploded view of the pole shelf, equipment base and dome.
Figure 8:
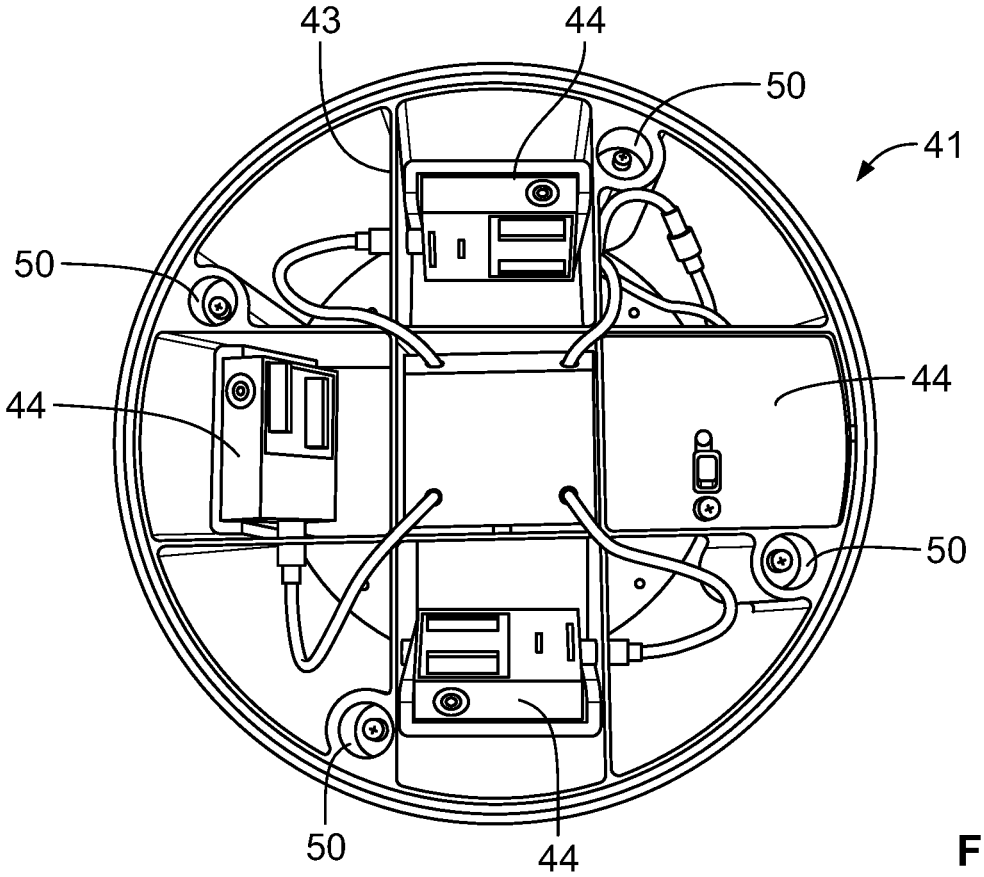
FIG. 8 is a top view of the equipment base.
Figure 9:
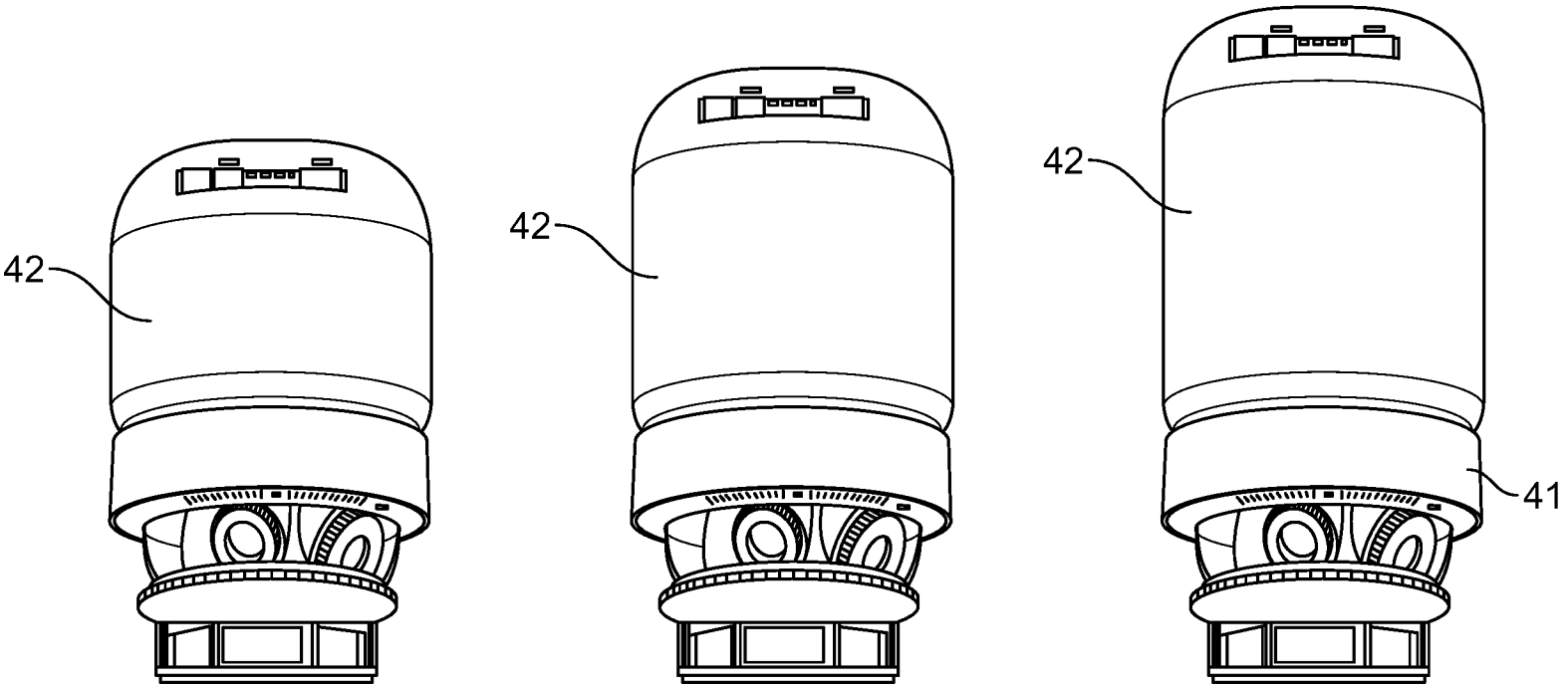
FIG. 9 shows exemplary size variances of the dome.

FIG. 4 shows a pole shelf 32 and overlook area 33 which is located near the top of the tower 30. The pole shelf is supported by a plurality of support arms 34 which are permanently attached to the tower 30 by welding or other means as one skilled in the art would know. The pod 40 is located at the top of the tower 30 by fixedly attached to the pole shelf 32, as shown in FIGS. 5-7, the weight load is held by the pole shelf 32 enabling the equipment base 41 to be made of tough structural plastic which allows for flexible design. It is contemplated that the pole shelf 32 is capable of supporting at least 750 lbs of weight in order to support the contemplated housed equipment 44 and pod 40. The equipment base 41 has a plurality of sections created by section walls 43 capable of housing various hardware and equipment 44, including but not limited to power cables, fiber communication cables, ventilation ports, fan cooling or heating elements, as shown in FIG. 8. The section walls 43 have at least one cable routing port 53 to allow for necessary cables 55 to pass through the structure. It is contemplated that the pole shelf 32 and equipment base 41 will have ventilation ports 52 to enable airflow to accommodate venting or fan circulation as an option for equipment 44 within the dome 42, as shown in FIG. 5.

Further, additional equipment 35, such as CCTV cameras, sensors, LED lighting, fans, or other desired equipment, may be mounted under the pole shelf 32 by bolting said equipment 35 to the support arms 34. The overlook area 33 and any equipment 35 mounted under the pole shelf 32 will be covered and protected by an overlook shroud 36, as shown in FIG. 2. In one embodiment, the overlook shroud 36 is fixedly attached to the support arms 34 by welded bolts 54 in the support arms 34, as shown in FIG. 4, and joined with brackets 56. It is contemplated that the overlook shroud 36 can be molded plastic or other durable and lightweight material and may be clear or have windows for CCTV or LED lighting or other mounted equipment 35 requiring visibility of the surrounding area. It is also contemplated that the overlook shroud 36 will have ducts or vents 52 to allow airflow as needed.

Figure 10:
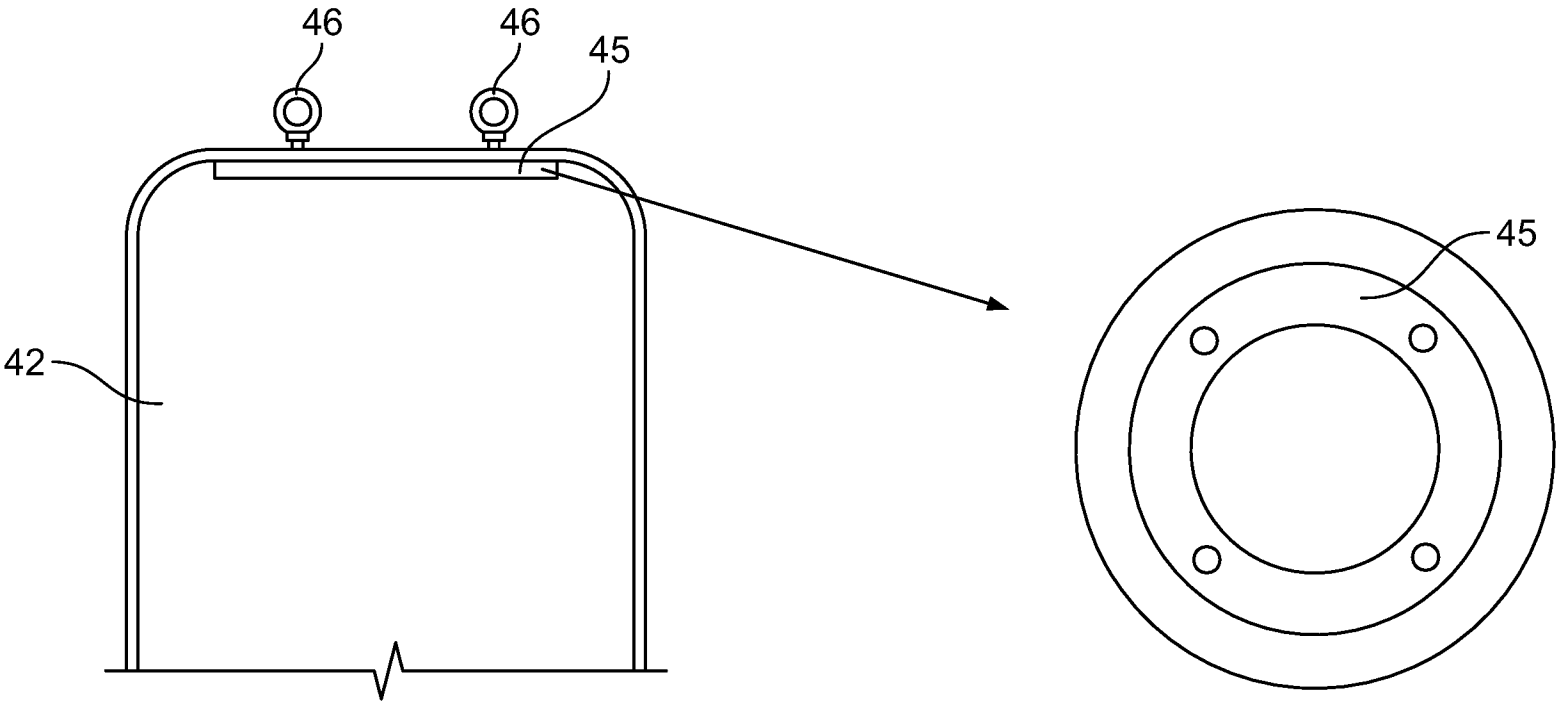
FIG. 10 is a top view of the ring lift plate inside the dome.
Figure 11:
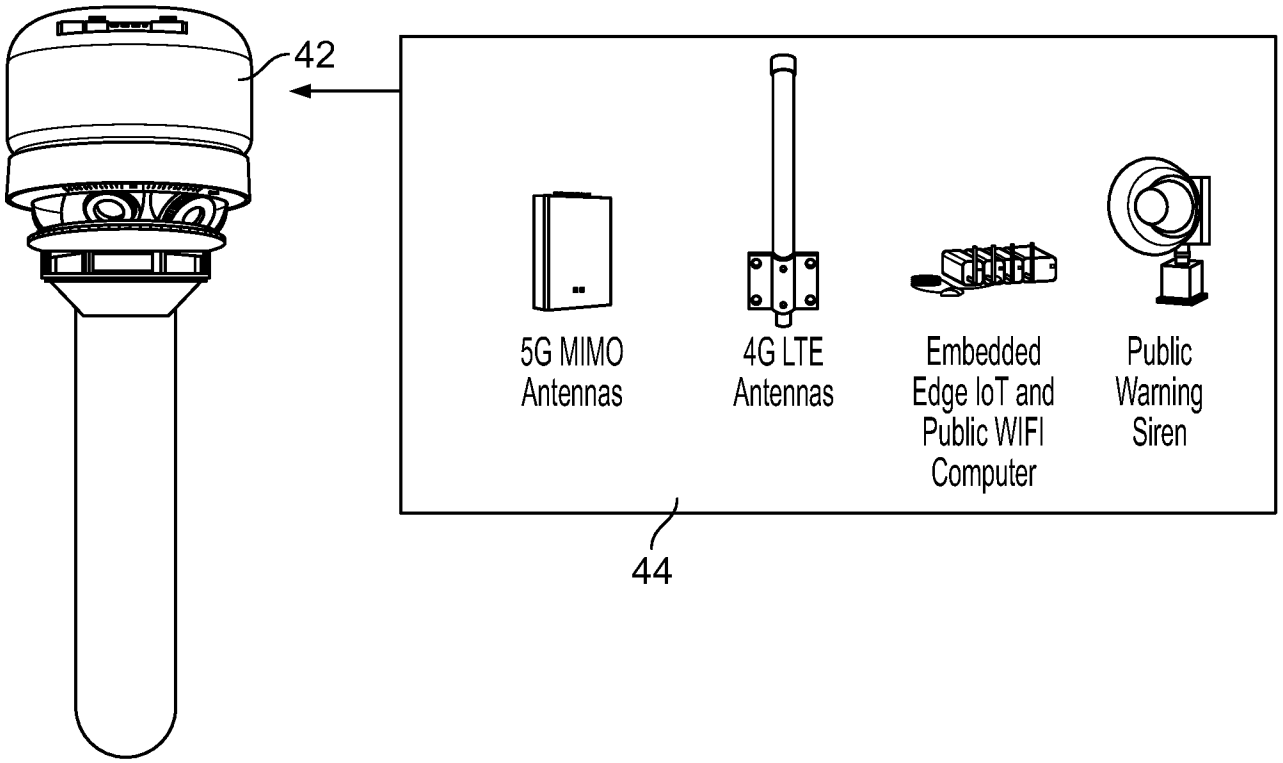
FIG. 11 shows exemplary equipment that may be housed in the pod unit.
Figure 12:
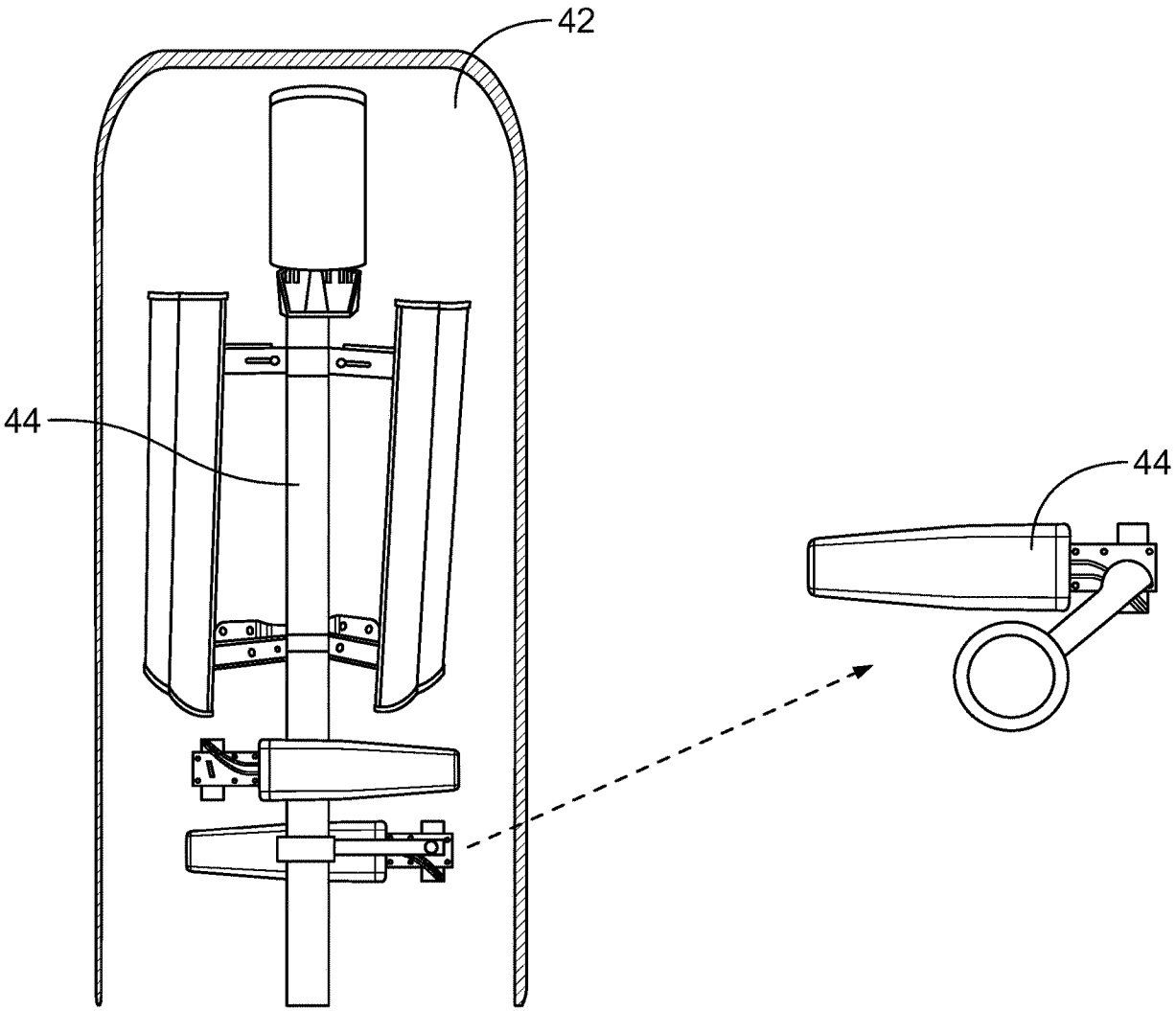
FIG. 12 shows an exemplary type of equipment housed in the dome.
Figure 13:
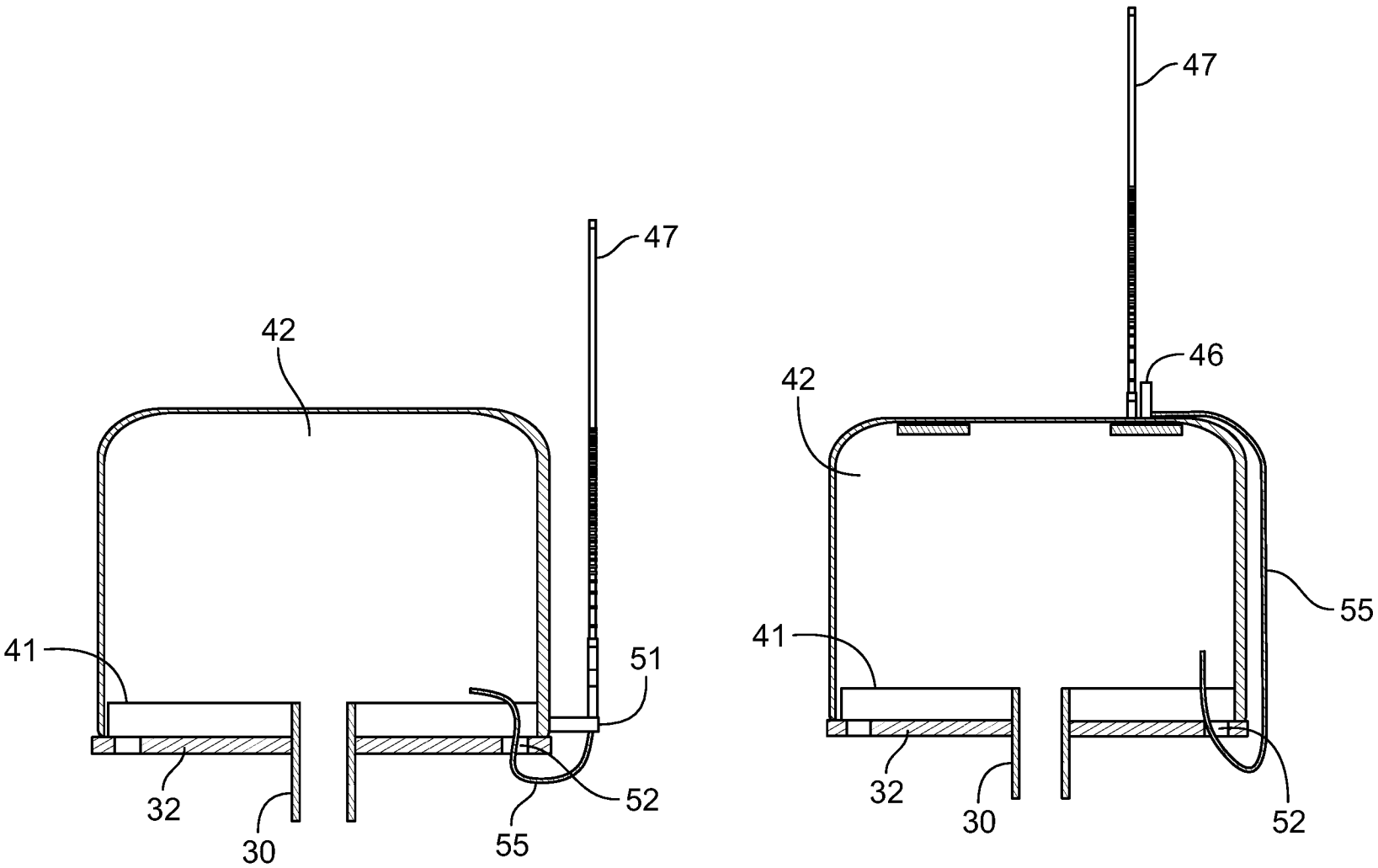
FIG. 13 shows optional external component placement on the dome.

The pod 40 may house a variety of equipment 44 including, but not limited to, MIMO antenna, 4G LTE antenna, cameras, lighting, alarms, public WIFI and other equipment as may be desired or contemplated in the future. The dome 42 can be made in multiple sizes to accommodate different needs for the housed equipment 44, as shown in FIG. 10. For example, a 4.5 feet diameter×6.5 feet height dome 42 will accommodate a MIMO antenna and accompanying equipment. Different diameters and heights can be employed to accommodate the necessary or desired equipment 44. It is contemplated that the interior top surface of the dome 42 will have a ring-shaped lift plate 45 which combines with at least one eye hook 46, as shown in FIG. 11, to enable easy lifting of the dome 42 while the open center of the lift plate 45 enables RF transmission and reception from the top of the dome 42 for GPS receivers. FIG. 12 depicts some exemplary equipment 44 that may be housed in the pod 40. As may be necessitated by the housed equipment 44, external components 47, such as an outside whip or dipole antenna, may be mounted to the exterior of the dome 42 as well by fixedly attaching to a dome 42 mounting bolt 51 or eye hook 46, as shown in FIG. 13. Air vent ports 52 may also be used to run necessary cables 55 out of the dome 42 for any external components 47.

Figure 14:
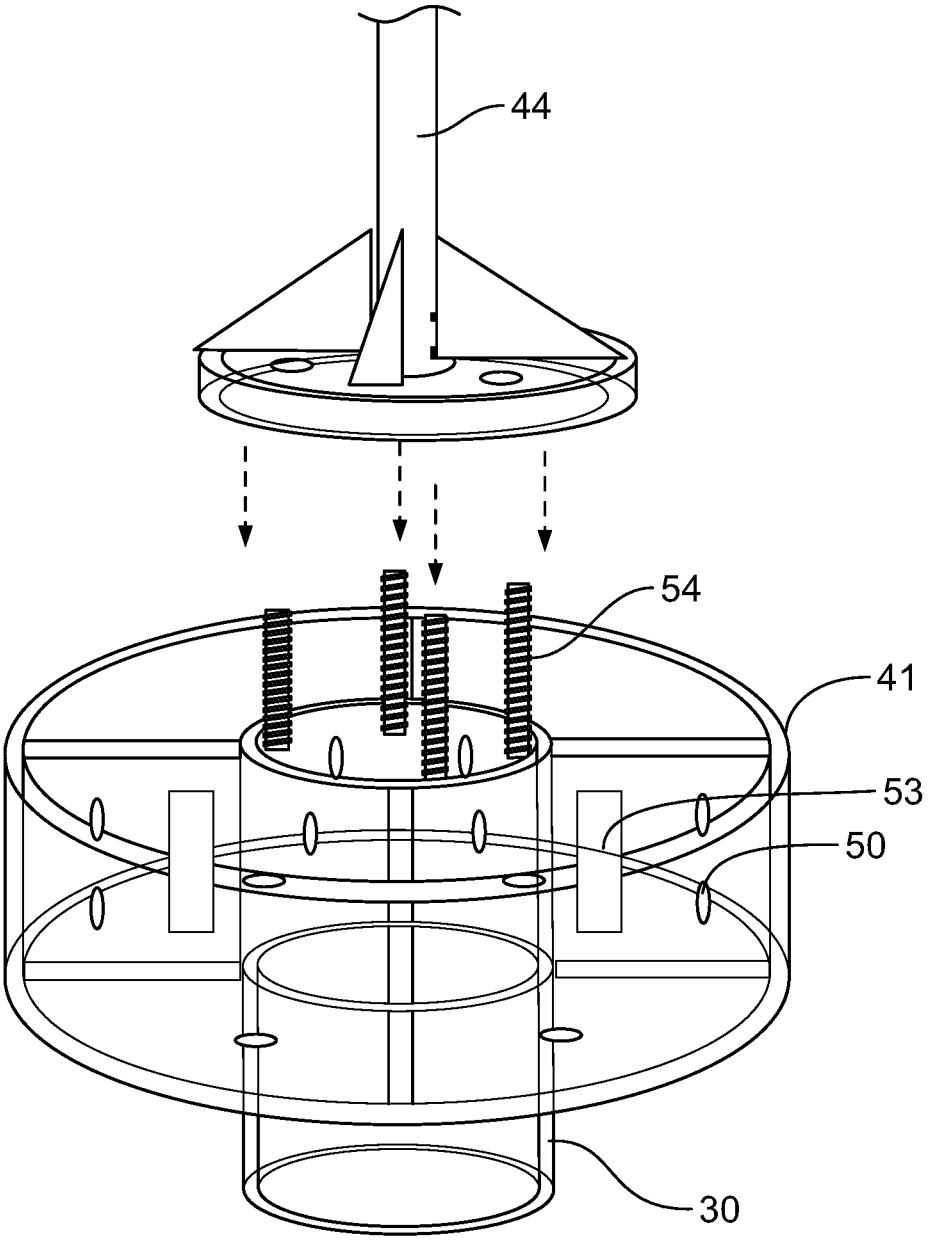
FIG. 14 is an exploded view of exemplary housed equipment and the equipment base.
Figure 15:
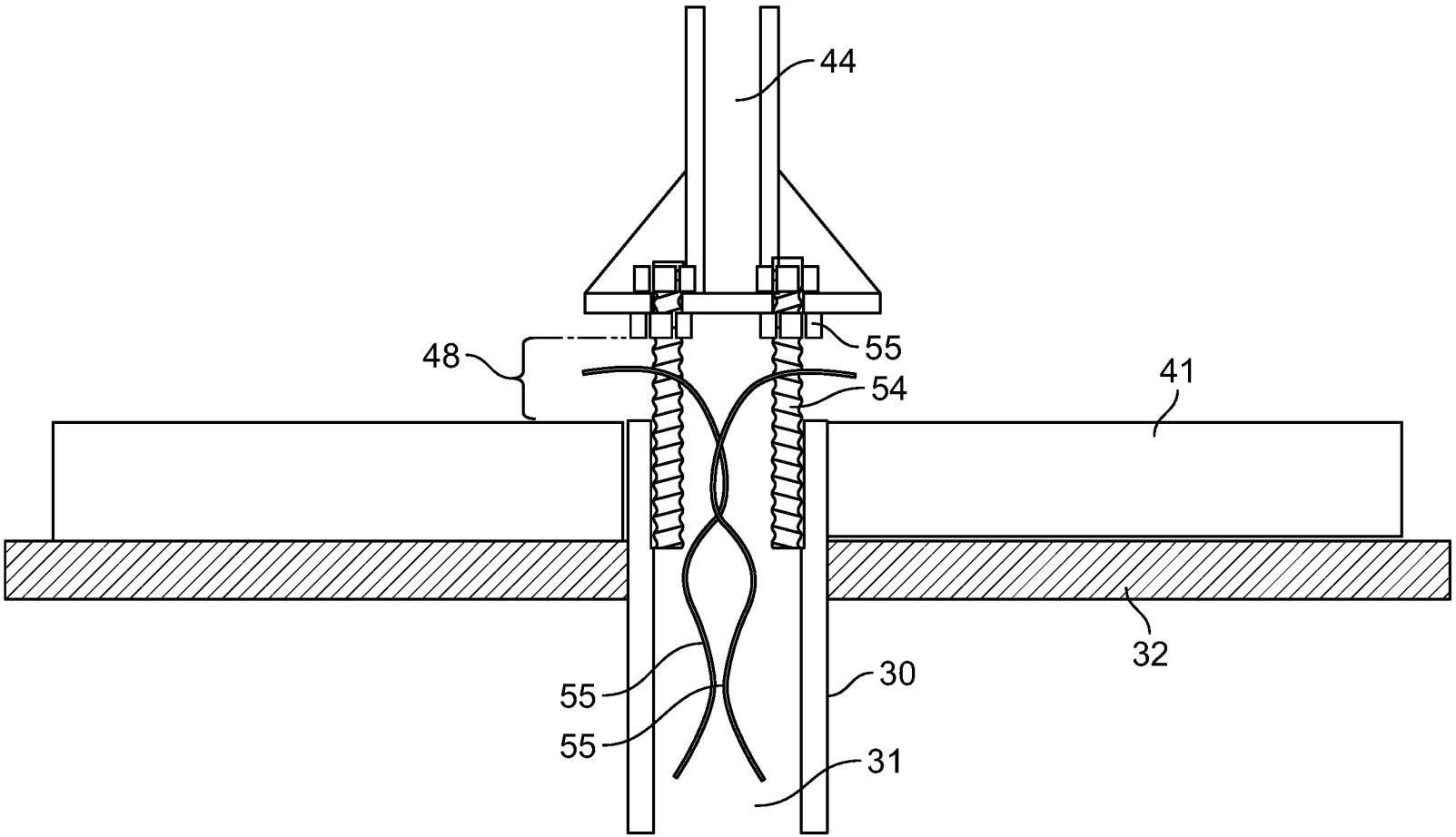
FIG. 15 is a side view of the exemplary housed equipment, equipment base, and pole shelf.

The housed equipment 44 is fixedly attached to the equipment base 41 as shown in FIGS. 14 and 15. In one embodiment, the housed equipment 44 is an antenna. The base of the antenna is mounted to the tower 30 through welded bolts 54 and leveling screws 55 leaving a clearance area 48 to allow cable access for the cables 55 running in the center of the tower 30.

Figure 16:
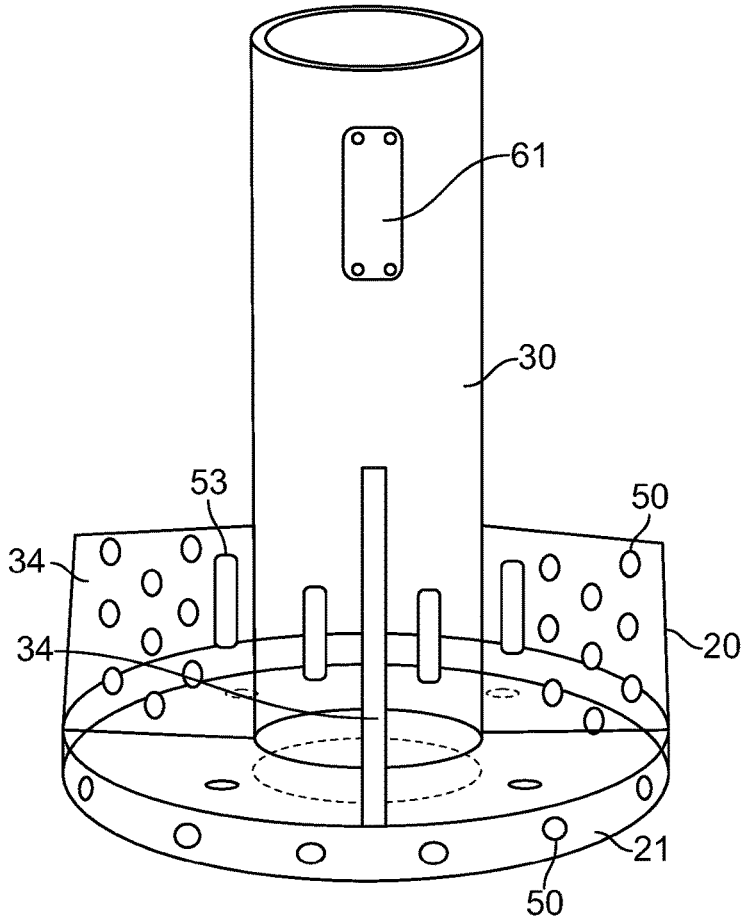
FIG. 16 is a perspective view of the module base and pole.
Figure 17:
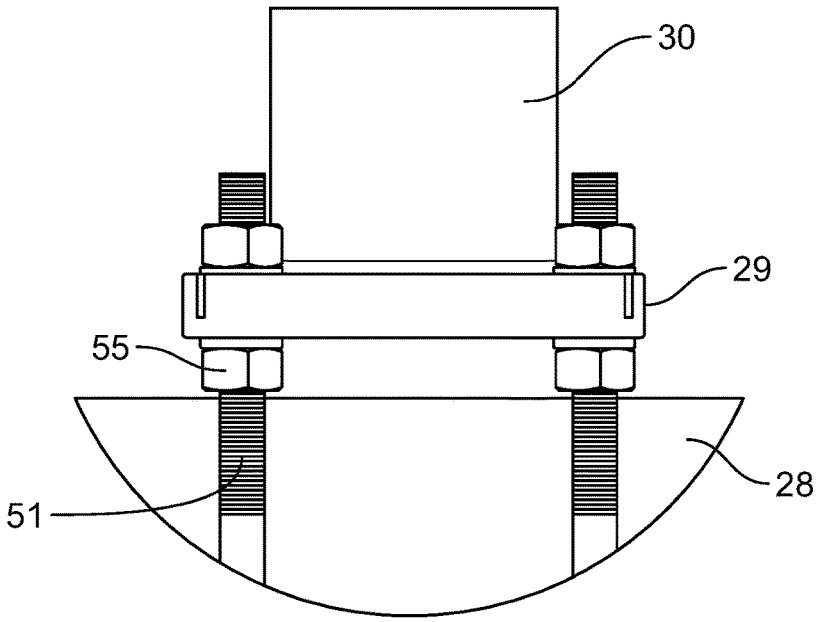
FIG. 17 is a side view of the pole and module base.
Figure 18:
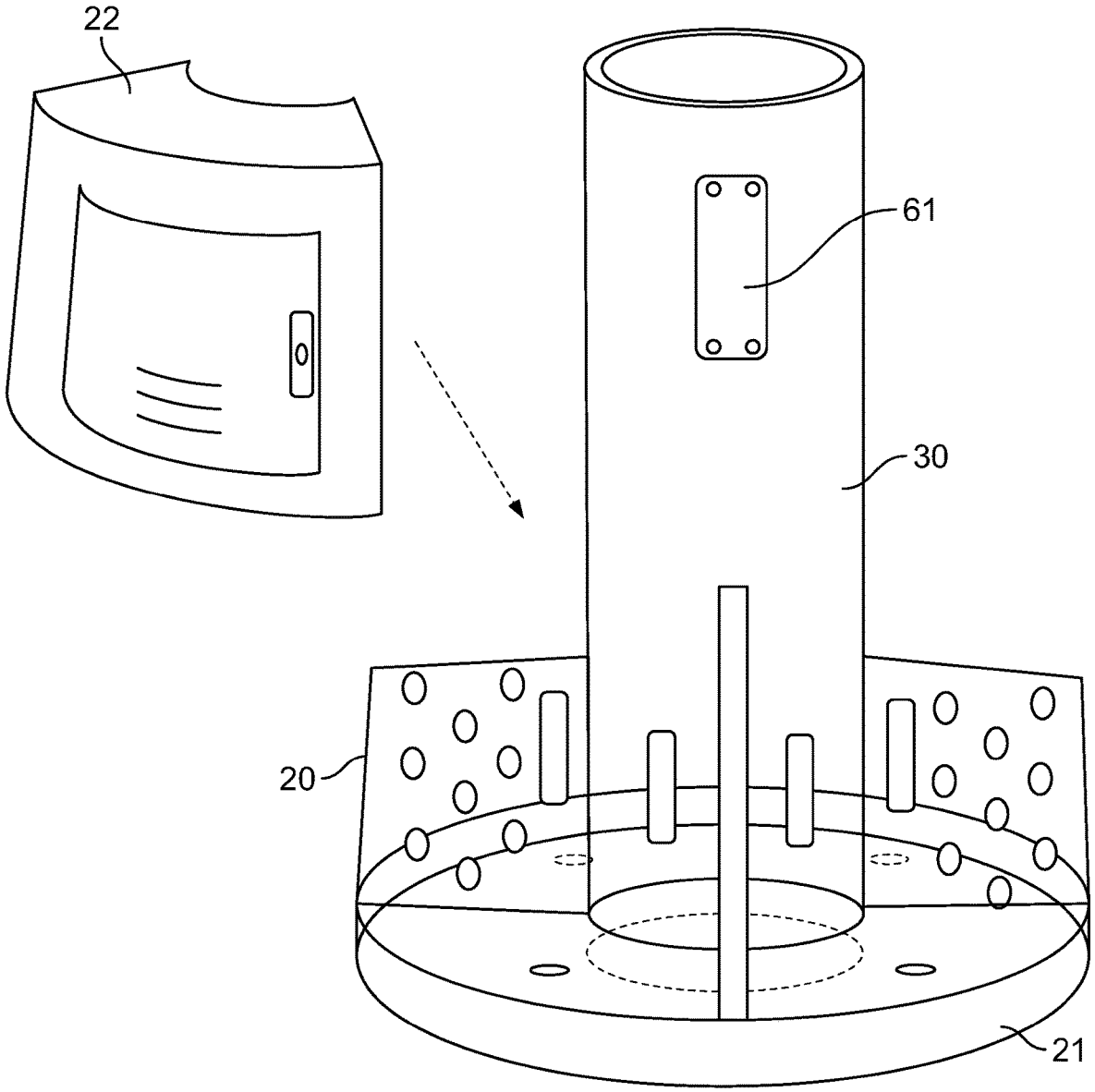
FIG. 18 is an exploded view of the base shroud and module base.
Figure 19:
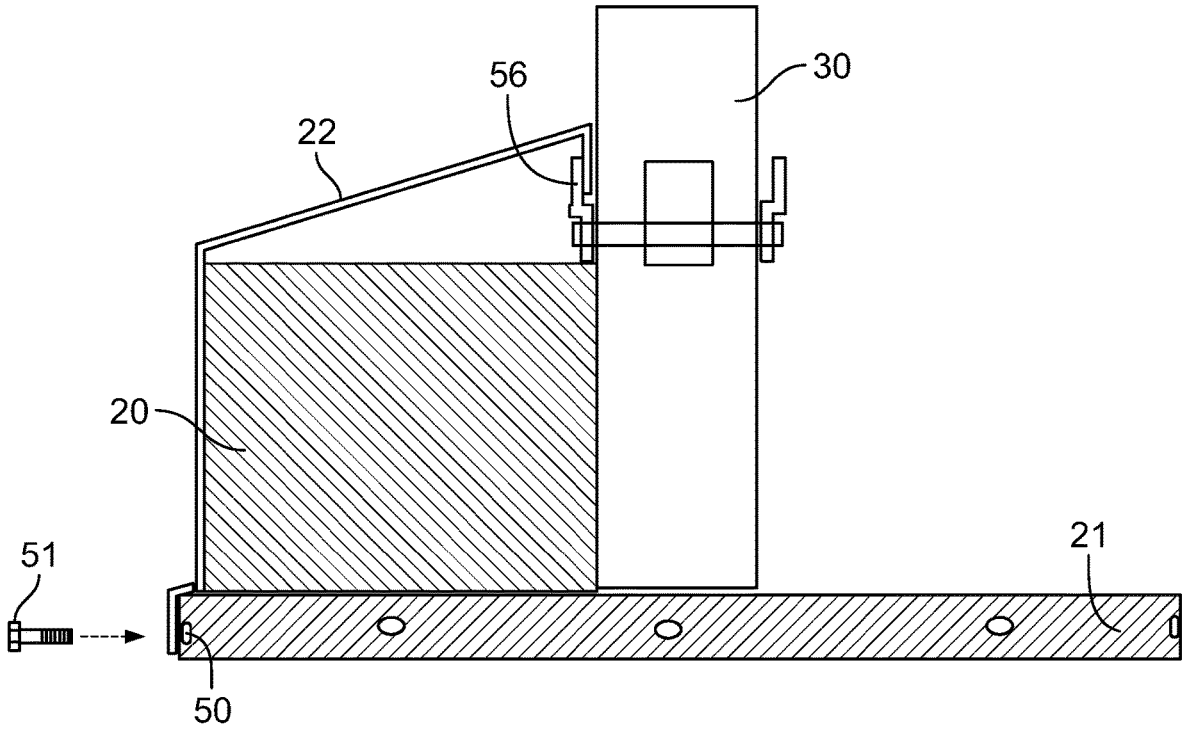
FIG. 19 is a side view of the base shroud and module base.
Figure 20:
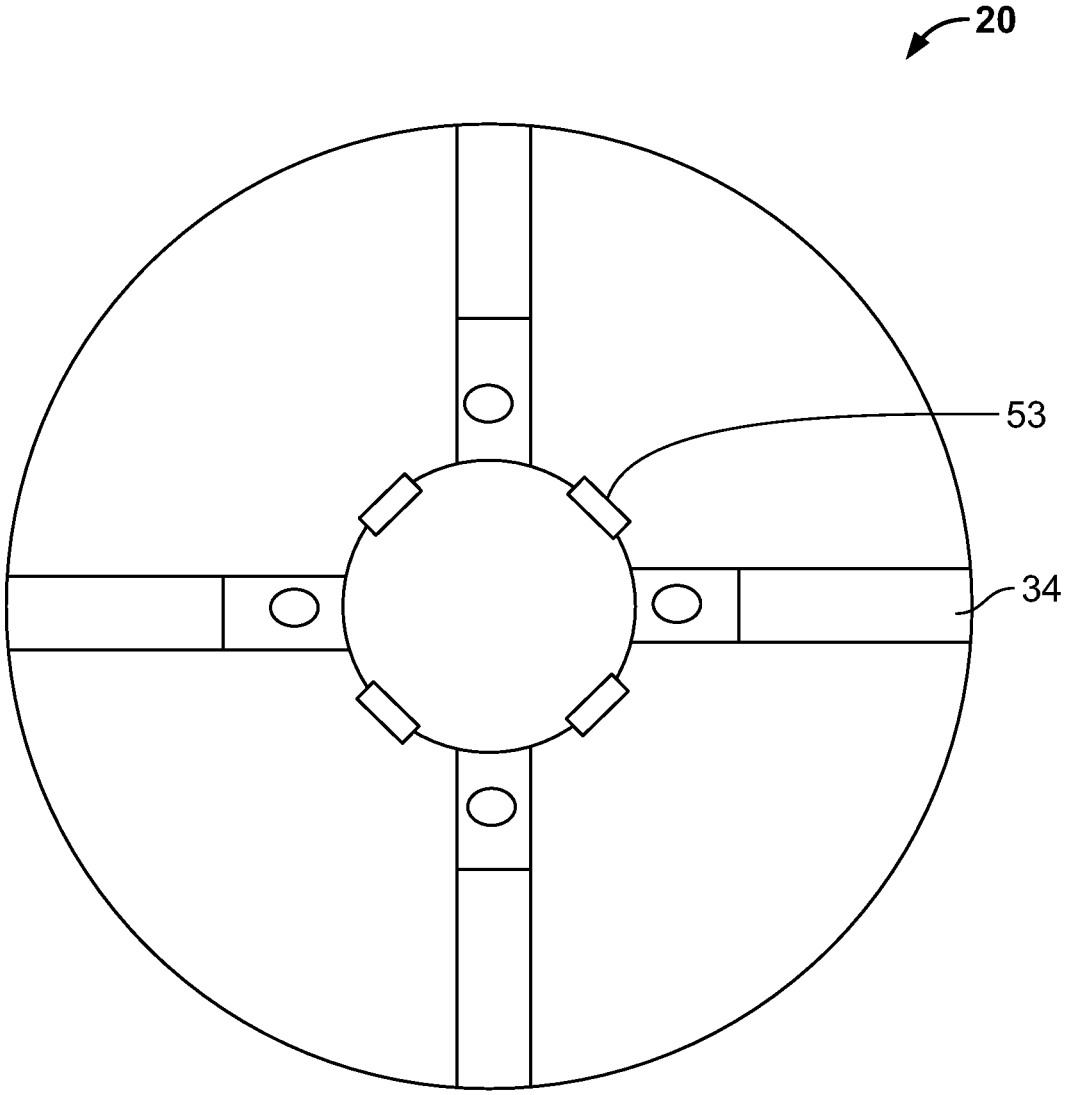
FIG. 20 is a top view of the module base.

The tower 30 is mounted with anchor bolts 51 embedded in a concrete foundation 28 through a base plate 21 located at the bottom of the tower 30, as shown in FIG. 17. Leveling nuts 55 can be used to ensure straight installation of the tower 30. At the base of the tower 30, there is a module base 20 which houses additional equipment 44. The module base 20 is divided into a plurality of sections by support arms 34, as shown in FIGS. 16 and 20. The support arms 34 and the tower 30 itself have cable routing ports 53 to allow cable access. The support arms 34 also have bolt holes 50 for mounting the housed equipment 44. The housed equipment 44 is covered and protected by a base shroud 22, as shown in FIG. 18. It is contemplated that a variety of base shroud 22 options and materials may be used. In one embodiment the base shroud 22 could be a permanently bolt locked total shroud which would require a utility crew to remove panels for access to cabling and equipment. In another embodiment, a cabinet enclosure base shroud 22 with lockable access door would enable an individual utility service operator to access. It is contemplated that each section of the module base 20 could have its own cabinet and distinct lock so operators only had access to their equipment. In one embodiment, the base shroud 22 is attached using shroud brackets 56 affixed to tower 30 and attached to the module base 20 with bolts 51, as shown in FIG. 19. It is also contemplated that the module base 20 and shroud 22 can be constructed from a variety of materials as long as it sufficiently protects the housed equipment 44 from the elements and meets civil codes for safety and security. Further, weather sealing can be provided using strip or other sealant between shroud 22 and module base 20. It is further contemplated that airflow management can be added if desired through fans or vents.

Figure 21:
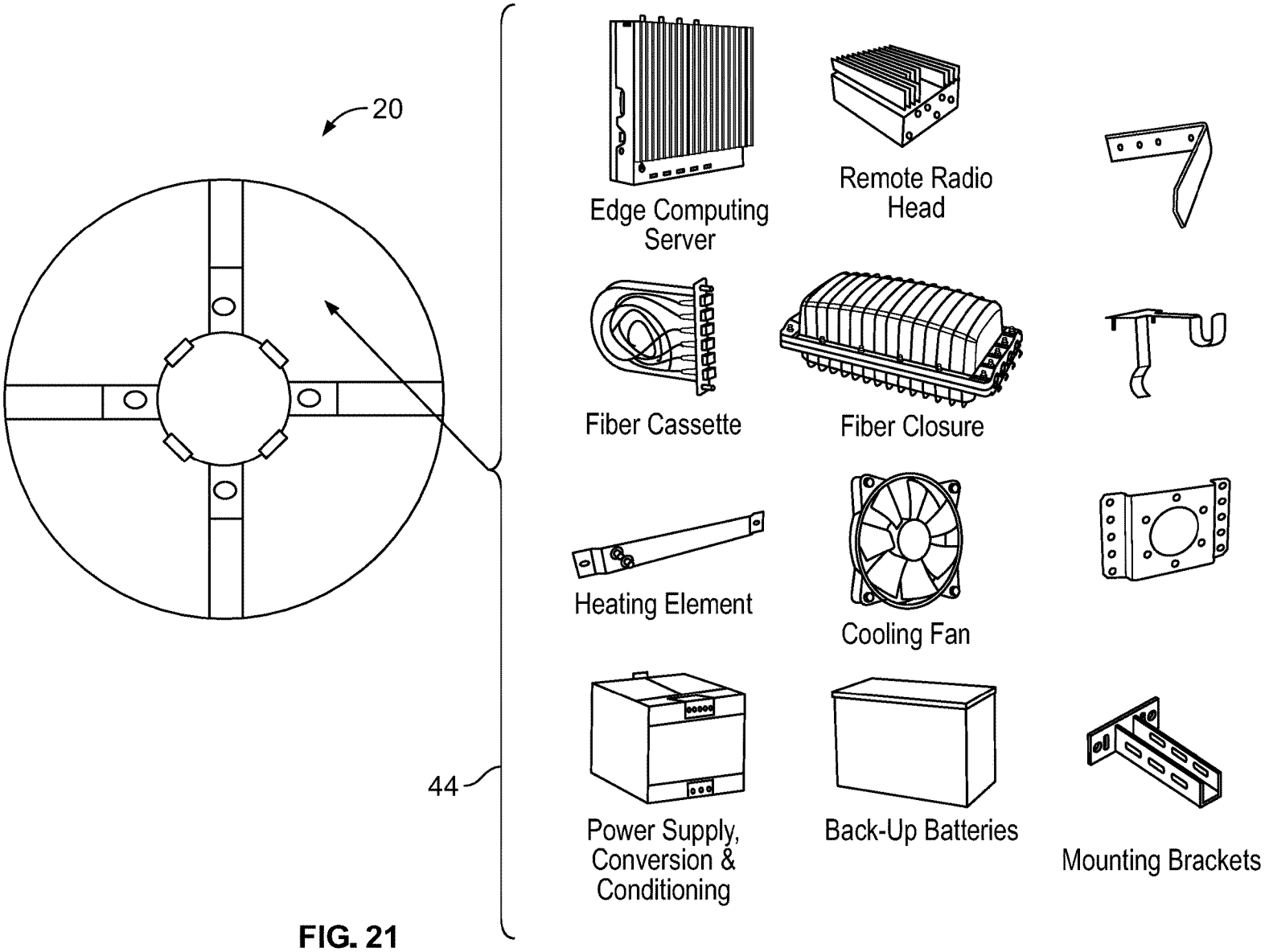
FIG. 21 shows exemplary equipment that may be in the equipment base of the pod unit.

The module base 20 houses equipment 44 that provides interconnection to power and communications cables 55 connected to underground cabling, as well as power supply, backup batteries, remote radio head, transformers, edge computing, fiber management, and other equipment as desired and necessary. FIG. 21 shows some exemplary equipment 44 that may be housed in the module base 20.

Figure 22:
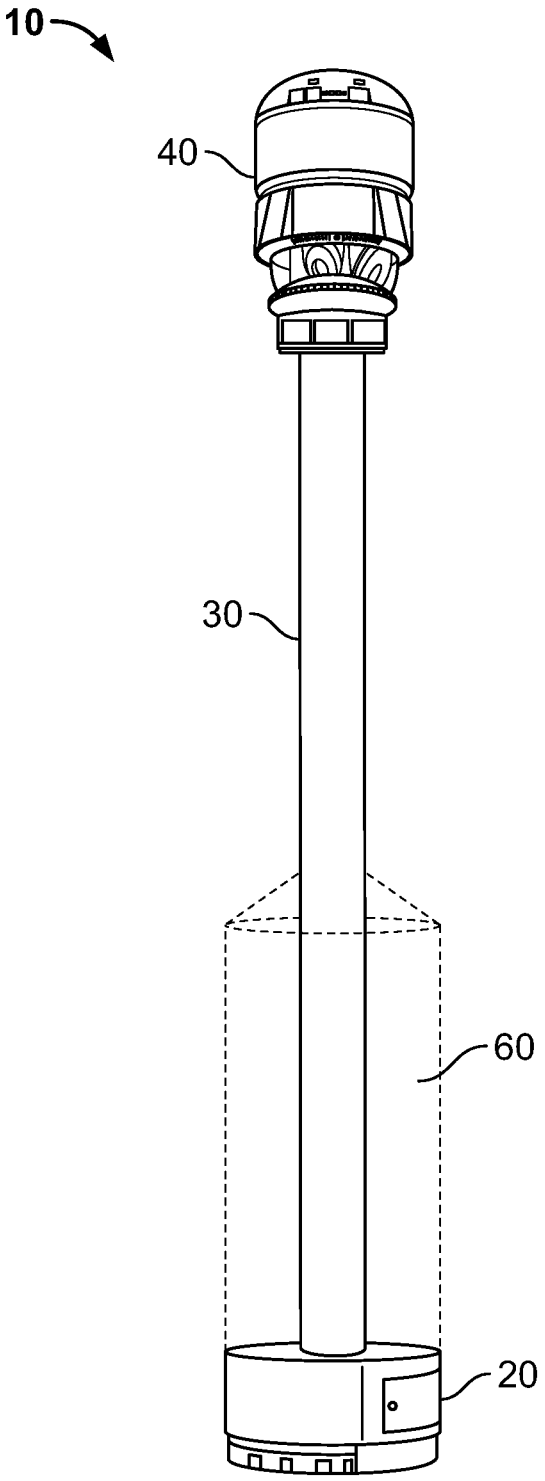
FIG. 22 is a side view of the module unit and optional service station.
Figure 23:
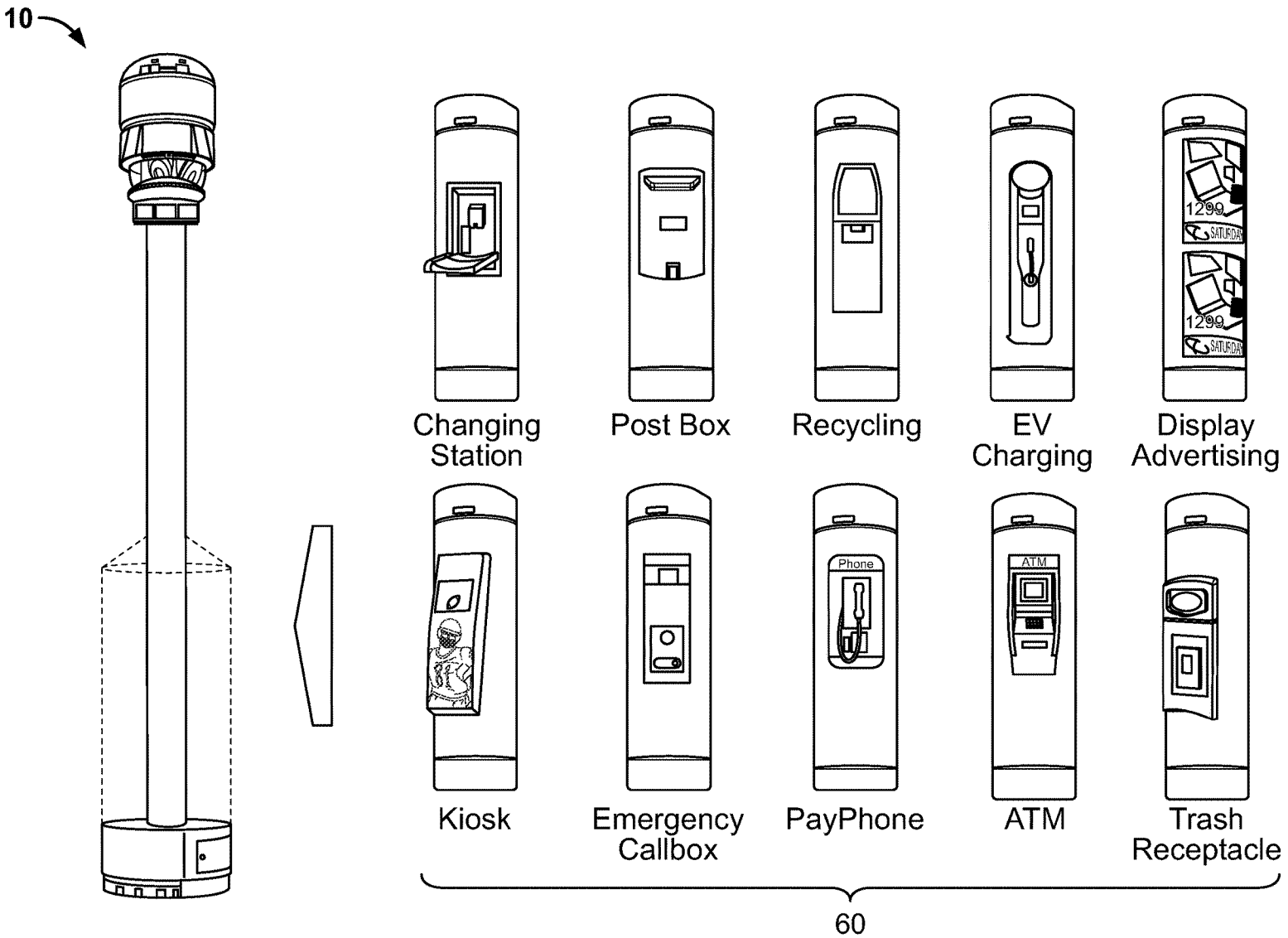
FIG. 23 shows exemplary service station types.
Figure 24:
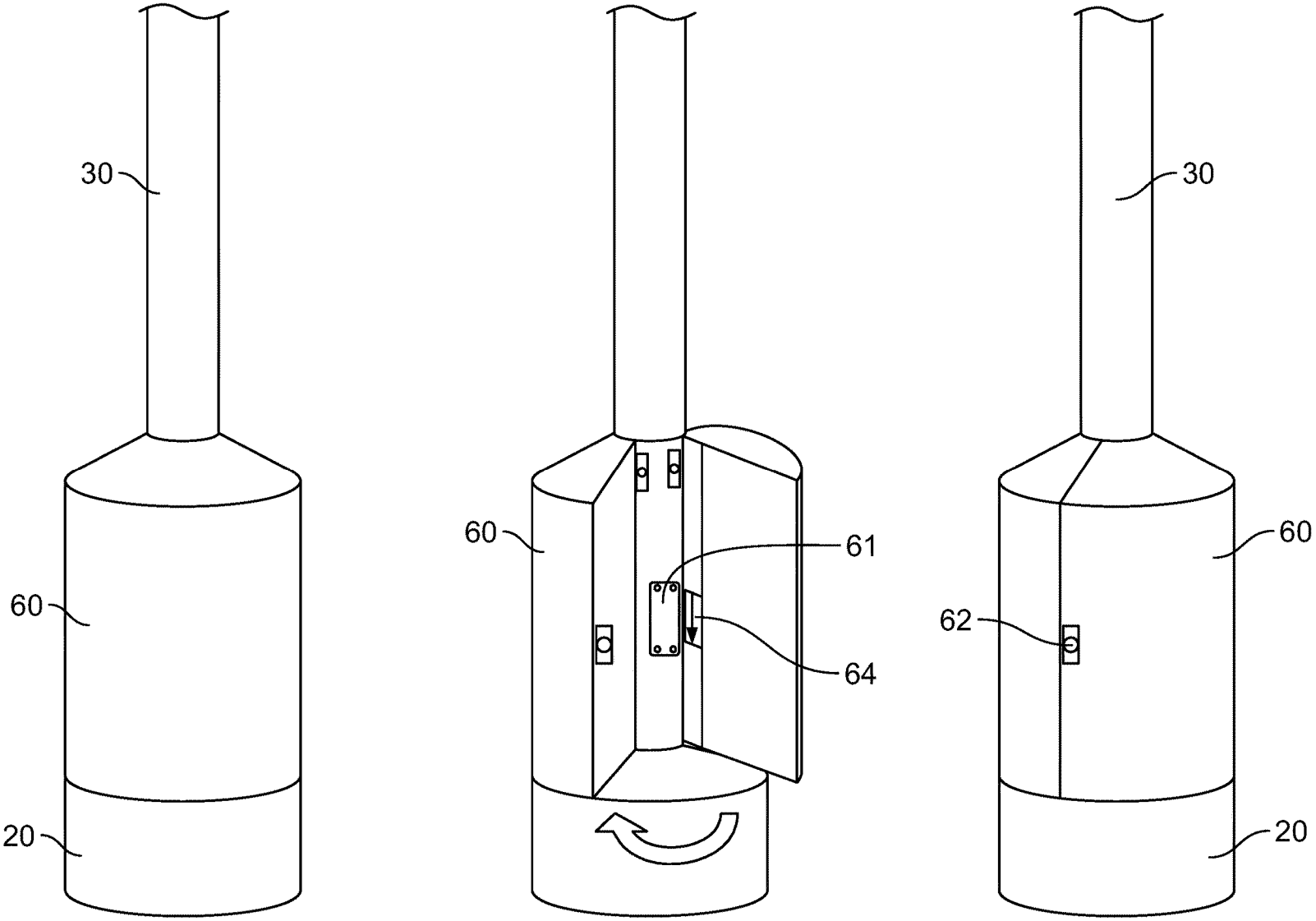
FIG. 24 shows a close up of the service station on the module unit in open and closed positions.
Figure 25:
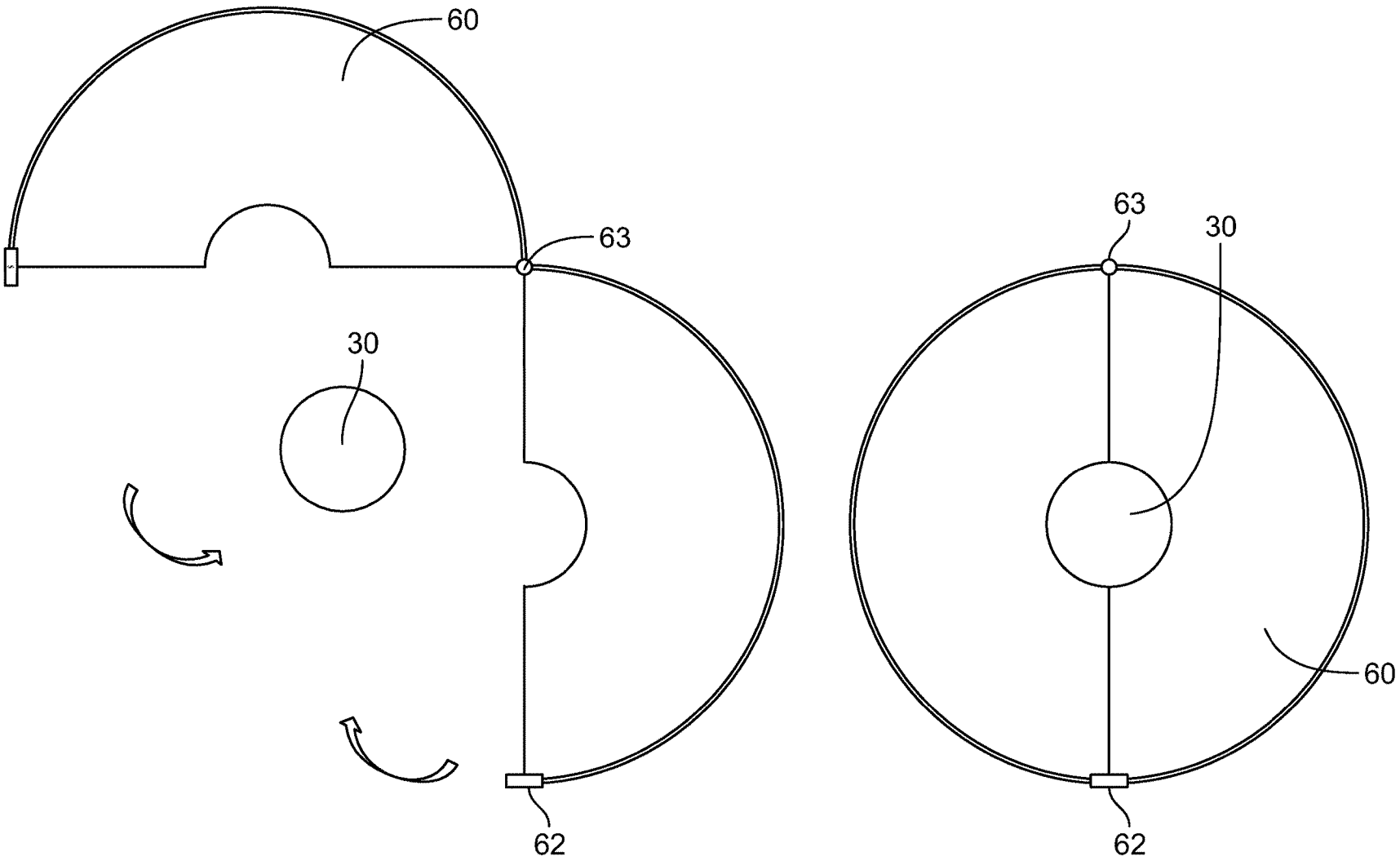
FIG. 25 shows a top view of the service station in open and closed positions.
Figure 26:
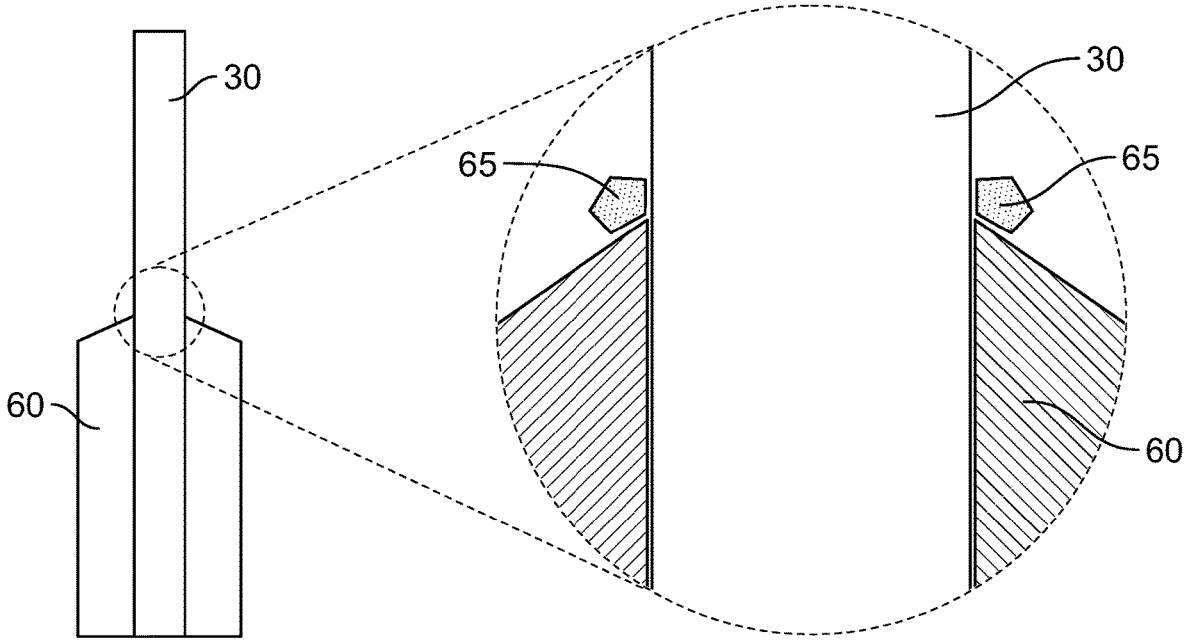
FIG. 26 is a magnified view of the top of the service station and corresponding pole area.

The tower 30 may also include an optional service station 60, as shown in FIGS. 22 and 23. Exemplary service stations 60 which include, but are not limited to, a kiosk, emergency call box, payphone, ATM, post box, recycling or trash collection receptacle, EV charging, changing station, advertising, other any other needed or future contemplated service. The service station 60 is positioned on top of the module base 20 and locked in place around the tower 30 secured by a lock 62, as shown in FIG. 24. The service station 60 is designed for easy field installation by a hinged clam-shell configuration as shown in FIG. 25. The hinge 63 allows the service station 60 to open at a lock point 62, be placed around the tower 30, and closed and locked into place. An optional access panel 61, as shown in FIG. 16, would provide cable access for the service station 60. After installing one side of the open clam-shell to the tower 30, an umbilical cable is attached from the module base 20 through a cable port and then the clam-shell is closed and locked, securing the service station 60 in place. It is contemplated that service stations may have a horizontal cable inset channel 64 at the height of the access panel 61 for routing cables 55 to mate with the access panel 61 and enabling 360° rotation of the service station 60. In one embodiment, the service station 60 may be waterproofed with weather seals along joining edges. In one embodiment of the present invention, it is contemplated that the service station would be made of HDPE or similar material as one skilled in the art would know. As shown in FIG. 26, a pipe collar clamp 65 with rubber seal at the top may also be used to waterproof the service station 60.

Figure 27:
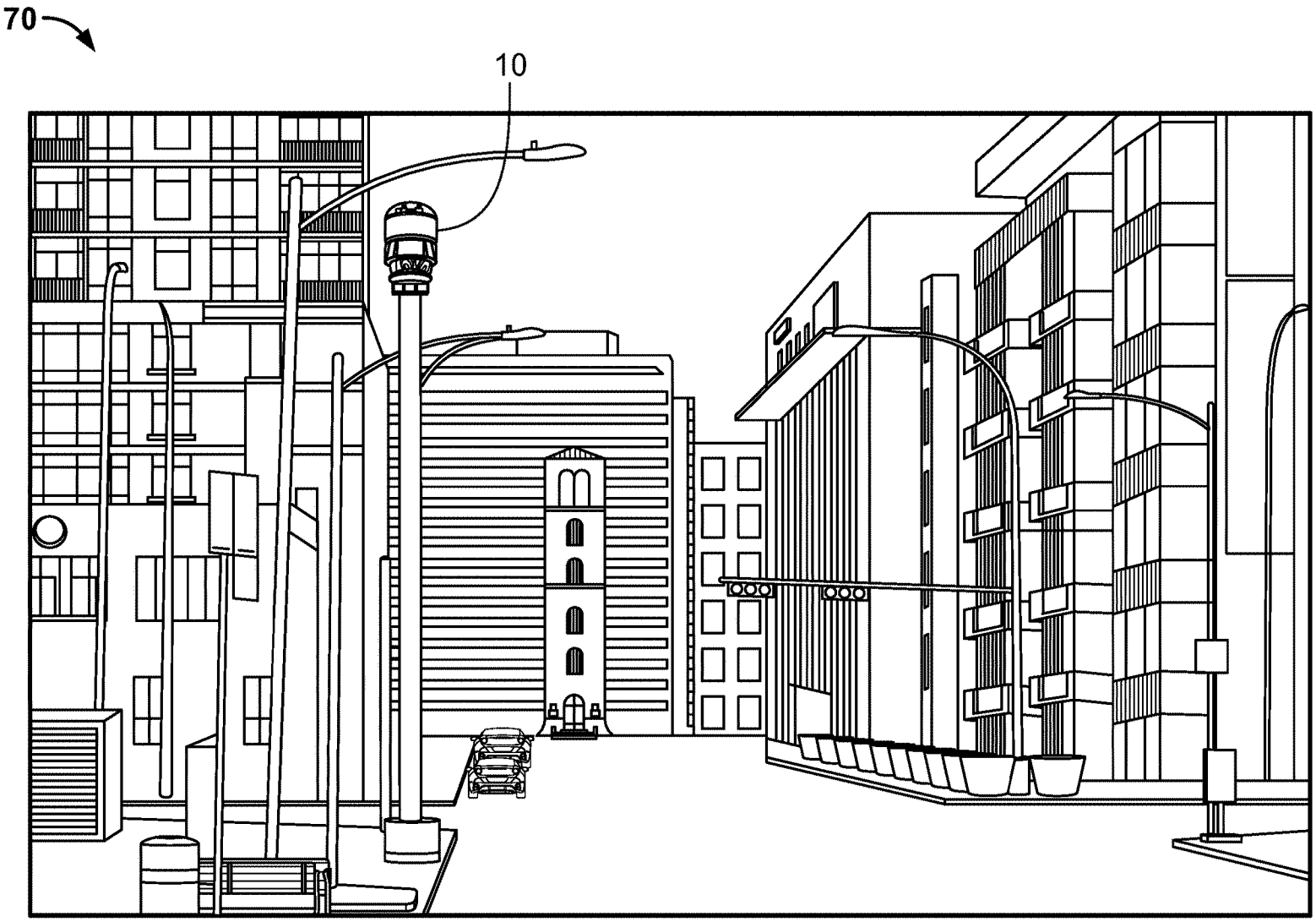
FIG. 27 is an environmental view of the module unit placed in an urban community.

FIG. 27 depicts a module unit 10 installed in an exemplary urban environment 70. It is contemplated that the dome 42 and equipment base 41 can be pre-configured offsite and installed fully-populated with housed equipment 44 onto the already placed tower 30 throughout an urban environment 70. It is also contemplated that preconfigured service stations 60 can be easily added, changed and removed for various services as needed or desired.

As used herein, to the extent that the term "includes" is used in either the detailed description or the claims, such term is intended to be inclusive in a manner similar to the term "comprising" as "comprising" is interpreted when employed as a transitional word in a claim.

The foregoing description and accompanying drawings illustrate the principles, preferred embodiments and modes of operation of the invention. However, the invention should not be construed as being limited to the particular embodiments described above. Additional variations of the embodiments described above will be appreciated by those skilled in the art. Therefore, the above-described embodiments should be regarded as illustrative rather than restrictive. Accordingly, it should be appreciated that variations to those embodiments can be made by those skilled in the art without departing from the scope of the invention or the spirit of the invention as defined by the following claims.

What is claimed is:

1. A module unit comprising:

a module base comprising:
- a base plate;
- a plurality of support arms;
- a base shroud;
- a plurality of ventilation ports; and
- a plurality of access ports;

a tower wherein the tower has a hollow center void space capable of allowing cables to be routed through the void space;

an overlook area where the overlook area comprises:
- a pole shelf;
- a plurality of support arms;
- a plurality of access ports;
- a plurality of ventilation ports; and
- an overlook shroud; and a pod comprising:
- an equipment base;
- a dome; and
- a plurality of access ports; and
- a plurality of ventilation ports;

wherein the access ports allow for routing cables to pass through the various components of the module unit; and wherein the ventilation ports provide for airflow to various areas of the module unit.

2. The module unit of claim 1 wherein the equipment base and the dome of the pod are fixedly attached to each other.

3. The module unit of claim 2 wherein the dome is made of weatherproof material, able to withstand sun radiation with minimal oxidation, extreme temperature, and high wind load without fracture or stress.

4. The module unit of claim 1 wherein the equipment base has a plurality of sections capable of housing various hardware and equipment.

5. The module unit of claim 1 wherein the pod houses various types of technology and equipment.

6. The module unit of claim 5 wherein the pod fixedly attached to the pole shelf at the top of the tower.

7. The module unit of claim 6 wherein the pole shelf is capable of carrying a load of at least 750 lbs.

8. The module unit of claim 7 wherein additional equipment is mounted to the support arms in the overlook area.

9. The module unit of claim 8 wherein the overlook shroud is fixedly attached to the support arms and covers the additional equipment mounted to the support arms to protect the overlook area.

10. The module unit of claim 1 wherein the module base has a plurality of sections capable of housing various hardware and equipment.

11. The module unit of claim 10 wherein the base shroud is a single piece permanently bolt locked with access panels.

12. The module unit of claim 10 wherein the base shroud is multiple component shrouds covering individual sections of the module base.

13. A module unit comprising:

a module base comprising:

a base plate;

a plurality of support arms;

a plurality of ventilation ports; and a plurality of access ports;

a tower wherein the tower has a hollow center void space capable of allowing cables to be routed through the void space;

an overlook area where the overlook area comprises:

a pole shelf;

a plurality of support arms;

a plurality of access ports;

a plurality of ventilation ports; and an overlook shroud;

a pod comprising:

an equipment base;

a dome; and a plurality of access ports; and a plurality of ventilation ports; and a service station;

wherein the access ports allow for routing cables to pass through the various components of the module unit; and wherein the ventilation ports provide for airflow to various areas of the module unit.

14. The module unit of claim 13 wherein the service station is a hinged clam-shell piece capable of being mounted around the tower on top of the module base.

* * * * *